US006744417B2

(12) United States Patent
Yamashita et al.

(10) Patent No.: US 6,744,417 B2
(45) Date of Patent: Jun. 1, 2004

(54) DISPLAY DEVICE AND METHOD FOR DRIVING THE SAME

(75) Inventors: Junichi Yamashita, Tokyo (JP); Tomohiro Kashima, Tokyo (JP)

(73) Assignee: Sony Corporation (JP)

( * ) Notice: Subject to any disclaimer, the term of this patent is extended or adjusted under 35 U.S.C. 154(b) by 294 days.

(21) Appl. No.: 09/878,289

(22) Filed: Jun. 12, 2001

(65) Prior Publication Data

US 2003/0206149 A1 Nov. 6, 2003

(30) Foreign Application Priority Data

Jun. 14, 2000 (JP) ..... P2000-177928

(51) Int. Cl.[7] ..... G09G 3/36
(52) U.S. Cl. ..... 345/92; 345/94; 345/96
(58) Field of Search ..... 345/96, 92, 79, 345/87, 88, 89

(56) References Cited

U.S. PATENT DOCUMENTS 5,253,091 A * 10/1993 Kimura et al. ..... 345/94
5,648,793 A * 7/1997 Chen ..... 345/96
5,790,092 A 8/1998 Moriyama
6,160,535 A * 12/2000 Park ..... 345/153
6,307,681 B1 * 10/2001 Aoki et al. ..... 359/645
6,335,719 B1 * 1/2002 An et al. ..... 345/98

FOREIGN PATENT DOCUMENTS

| | | |
|---|---|---|
| EP | 466 378 | 1/1992 |
| EP | 838 801 | 4/1998 |
| EP | 848 368 | 6/1998 |
| EP | 1 037 193 | 9/2000 |
| JP | 11-271789 | 10/1999 |
| JP | 2000-267067 | 9/2000 |
| JP | 2000-267634 | 9/2000 |

* cited by examiner

*Primary Examiner*—Steven Saras
*Assistant Examiner*—Fritz Alphonse
(74) *Attorney, Agent, or Firm*—Rader, Fishman & Grauer, P.L.L.C.; Ronald P. Kananen

(57) ABSTRACT

A liquid crystal display driven by a dot-line inversion driving method in combination with a 2-step dot sequential precharge driving method which, if black window or black lines are displayed, is free of horizontal trails on circumscribing portions thereof is provided. Before video signals having opposite polarities are applied to signal lines, first, a full-line precharge pulse is generated in the horizontal blanking periods, and precharge gray signals which have the same polarity as that of the previous pixel potential are written together based on the full-line precharge pulse. Then, precharge black signals having the same polarity as that of one of the video signals and precharge gray signals having the same polarity of that of the other video signal are written in two steps.

10 Claims, 11 Drawing Sheets

| | | | | |
|---|---|---|---|---|
| ( d-1 ) L | | ( d-3 ) L | | (DUMMY) |
| ( 1-1 ) H | ( 1-2 ) H | ( 1-3 ) H | ( 1-4 ) H | FIRST ROW |
| ( 2-1 ) L | ( 2-2 ) L | ( 2-3 ) L | ( 2-4 ) L | SECOND ROW |
| ( 3-1 ) H | ( 3-2 ) H | ( 3-3 ) H | ( 3-4 ) H | THIRD ROW |
| ( 4-1 ) L | ( 4-2 ) L | ( 4-3 ) L | ( 4-4 ) L | FOURTH ROW |
| | ( d-2 ) H | | ( d-4 ) H | (DUMMY) |

DISPLAY DEVICE AND METHOD FOR DRIVING THE SAME

BACKGROUND OF THE INVENTION

1. Field of the Invention

The present invention relates to a display device and a method of driving the same, and more particularly the present invention relates to an active matrix display device that is driven by a dot-line inversion driving method in combination with a dot sequential precharge driving method and a method of driving the same.

2. Description of the Related Art

One known driving method of a display device having pixels arranged in a matrix, such as an active matrix liquid crystal display (LCD), is a dot sequential driving method in which pixels are sequentially driven for one line (one row) on a pixel-by-pixel basis. The dot sequential driving method includes a 1H inversion driving method and a dot inversion driving method.

The 1H inversion driving method experiences the following problems. When video signals are written, resistance exists between horizontally adjacent pixels on lines (hereinafter referred to as "Cs lines") which distribute a predetermined dc voltage to pixels as a common voltage Vcom, and parasitic capacitance exists at intersections of the Cs lines and signal lines. This causes the video signals to jump over onto the Cs lines or gate lines, resulting in oscillations in the potentials of the Cs lines toward the same polarity as those of the video signals. Therefore, significant horizontal crosstalk or defective shading occurs, leading to significant degradation of the picture quality.

When the pixels maintain pixel information in a period of one field, the potentials of the signal lines oscillate every one horizontal scanning period (1H). In the 1H inversion driving method, the polarities of the video signals written to horizontally adjacent pixels are the same, and the potentials of the signal lines increasingly oscillate. This potential oscillation jumps over to the pixels due to the source-drain coupling of pixel transistors, causing significant vertical crosstalk, and resulting in degradation of the picture quality.

On the other hand, in the dot inversion driving method, video signals having opposite polarities are concurrently written to horizontally adjacent pixels and the potential oscillations of the Cs lines or the signal lines are cancelled out between the adjacent pixels, thereby solving the degradation problem of the picture quality exhibited by the 1H inversion driving method. However, since the polarities of the video signals written to horizontally adjacent pixels are opposite, the fields of the adjacent pixels produce domains (optically dropped regions) at the edges of apertures in the pixels. As a result, the aperture ratio of the pixels is reduced, thus providing a lower transmittance and leading to a reduction in contrast.

In order to address such a deficiency, there has been proposed a driving method termed the "dot-line inversion driving method" in which video signals having polarities opposite to each other are concurrently written to two odd-numbered rows of pixels that are spaced apart, e.g., two rows apart vertically, in adjacent pixel columns so that the polarities of horizontally adjacent pixels are the same while the polarities of vertically adjacent pixels are opposite in the array of pixels to which the video signals have been written.

In the dot-line inversion driving method, video signals having opposite polarities are applied to adjacent signal lines, as in the dot inversion driving method, and the polarities .of horizontally adjacent pixels are the same in the array of pixels to which the video signals have been written, as in the 1H inversion driving method. Therefore, degradation of the picture quality due to horizontal crosstalk or shading can be prevented without having to reduce the aperture ratio of the pixels.

However, when video signals written to pixels are inverted every 1H during the dot sequential driving, a significant charging/discharging current when the video signals are written to the signal line extending along each column of pixels appears as vertical fringes on the display screen. In order to reduce the charging/discharging current during the writing of the video signals as much as possible, a precharge driving method has been adopted in which precharge signals are written in advance before the video signals are written.

In general, gray levels are most likely to produce visible vertical fringes. Therefore, the precharge signal level is typically set at a gray level which is most likely to produce visible vertical fringes. If the precharge signal level is set at a gray level, however, vertical crosstalk occurs when a window pattern and the like are displayed, because the amount of source-drain optical leakage of pixel transistors differs according to location from picture to picture, and results in degradation of the picture quality.

In order to prevent such vertical crosstalk, the precharge signal level should be set at the black level, thereby making the source-drain leakage current of the pixel transistors uniform over the entire screen. If the precharge signal level is set at the black level, however, vertical fringes, as previously described, again appear. In summary, vertical crosstalk and vertical fringes are in a trade-off relation.

Accordingly, a 2-step dot sequential precharge method has been proposed in which a black-level signal and a gray-level signal are precharged in two steps. FIG. 8 illustrates a circuit structure of a precharge driving circuit 100 in the active matrix liquid crystal display driven by the 2-step dot sequential precharge method.

In FIG. 8, the precharge driving circuit 100 includes a shift register 101 and a precharge switching circuit 102. When a precharge start pulse PST is input, the shift register 101 shifts or transfers the precharge start pulse PST in turn to shift stages (S/Rs) in synchronization with horizontal clocks HCK and HCKX having opposite phases to each other, and successively outputs it as precharge control pulses PCC1, PCC2, and so on from the shift stages.

The precharge control pulses PCC1, PCC2, etc. are supplied to the precharge switching circuit 102. The precharge switching circuit 102 also receives an odd-column precharge black signal PsigBo via a precharge signal line 103*o*, an even-column precharge black signal PsigBe via a precharge signal line 103*e*, an odd-column precharge gray signal PsigGo via a precharge signal line 104*o*, and an even-column precharge gray signal PsigGe via a precharge signal line 104*e*.

In the precharge switching circuit 102, a precharge switch 106-1*b* is connected between a signal line 105-1 of a pixel section and the precharge signal line 103*o*, a precharge switch 106-1*g* is connected between the signal line 105-1 and the precharge signal line 104*o*, a precharge switch 106-2*b* is connected between a signal line 105-2 of the pixel section and the precharge signal line 103*e*, and a precharge switch 106-2*g* is connected between the signal line 105-2 and the precharge signal line 104*e*. Other precharge switches are further connected in the same way.

The precharge control pulses PCC1, PCC2, etc. that are output from the shift stages of the shift register 101 are used as drive signals of the precharge switches 106-1*b*, 106-1*g*, 106-2*b*, 106-2*g*, etc.

Specifically, the precharge control pulse PCC1 from the first stage is applied to the precharge switch 106-1*b* as a switch driving pulse PSD1*b*, the precharge control pulse PCC3 from the third stage is applied to the precharge switch 106-1*g* as a switch driving pulse PSD1*g*, the precharge control pulse PCC2 from the second stage is applied to the precharge switch 106-2*b* as a switch driving pulse PSD2*b*, and the precharge control pulse PCC4 from the fourth stage is applied to the precharge switch 106-2*g* as a switch driving pulse PSD2*g*. Other precharge control pulses are further applied in the same way to the subsequent precharge switches.

FIG. 9 is a timing chart of the precharge start pulse PST, the horizontal clock HCK, the black-level switch driving pulses PSD1*b*, PSD2*b*, PSD3*b*, PSD4*b*, and PSD5*b*, and the gray-level switch driving pulses PSD1*g*, PSD2*g*, PSD3*g*, and PSD4*g*.

If black windows or black lines are displayed on an active matrix liquid crystal display driven by the dot-line inversion driving method in combination with the dot sequential precharge driving method, so-called trails in which black lines appear over and along the horizontal scan direction (hereinafter referred to as "horizontal trails") occur on circumscribing portions thereof having a higher contrast in intensity, as shown in FIG. 10. Such horizontal trails can degrade the picture quality. The cause of horizontal trails is described as below.

In the dot-line inversion driving method, as previously described, the polarity of the input video signal is inverted from positive to negative or vice versa at odd columns and even columns of pixels with reference to the common voltage Vcom that is commonly supplied to the pixels and is also inverted every 1H. The resulting polarities of the pixel potentials are shown in FIG. 11, in which pixel potentials which are higher and lower than the common voltage Vcom are indicated by H and L, respectively.

If black windows or black lines are displayed, the pixel potentials shown in FIG. 12 are input to the circumscribing portions thereof. In FIG. 12, G represents the gray level and B represents the black level.

FIG. 13 depicts how the potentials of the signal lines vary when the 2-step dot sequential precharge driving method is considered.

In this illustration, as an example, the H and L levels of the precharge gray signals are set at 10 V and 5 V, respectively, and the H and L levels of the precharge black signal are set at 13 V and 2 V, respectively. In a pixel signal, typically, the H and L levels of the gray signal are 9 V and 6 V, respectively, and the H and L levels of the black signal are 13 V and 2 V, respectively.

Referring to FIG. 13, apparently, the potential of the signal line for an odd column varies in the following order: gray L level of an N-th stage pixel potential; precharge black H level; precharge gray H level; and, black H level of an (N+1)-th stage pixel potential. The potential of the signal line for an even column varies in the following order: black H level of an N-th stage pixel potential; precharge black L level; precharge gray L level; and, black L level of an (N+1)-th stage pixel potential.

In this illustration, the potential variations from the N-th stage pixel potential to the precharge black signal level are +7 V for an odd column and −11 V for an even column, and the potential variations cannot be therefore offset. Due to the presence of a potential difference between an odd column and an even column, horizontal trails occur, as described above. Generally, the potential variations of the signal lines are coupled through the parasitic capacitance to gate lines that are connected to rows of gate electrodes of pixel transistors or to Cs lines which distribute the common voltage Vcom to the pixels.

Therefore, if black windows or black lines are displayed using the pixel potentials, as shown in FIG. 12, the coupling cannot be offset between an odd column and an even column, causing the oscillations to be carried on the gate lines and the Cs lines. The oscillations are applied to other pixels as well as those in window bands when the video signals are written, thereby causing horizontal trails of the windows.

SUMMARY OF THE INVENTION

Accordingly, it is an object of the present invention to provide a display device driven by a dot-line inversion driving method in combination with a dot sequential precharge driving method which, if black windows or black lines are displayed, is free of horizontal trails on circumscribing portions thereof, and to provide a method of driving the same.

To this end, according to the present invention, a display device includes a pixel section having pixels arranged in a matrix, a signal line extending along each column of pixels, and a gate line extending across two odd-numbered rows that are spaced apart in adjacent pixel columns. The display device further includes a first driving unit for applying scan pulses to the gate lines while scanning the pixels of the pixel section in the row direction, a second driving unit for sequentially providing video signals having opposite polarities to adjacent pixels via the signal lines, the pixels being connected to the gate lines to which the scan pulses are applied by the first driving unit, and a third driving unit. The third driving unit first provides constant level precharge signals together in the horizontal blanking periods before the video signals having opposite polarities are applied to the signal lines by the second driving unit, and then sequentially provides a black-level precharge signal and a predetermined color level precharge signal. The black-level precharge signal has the same polarity as that of one of the video signals, and the predetermined color level precharge signal has the same polarity as that of the other video signal.

When a horizontal scan is performed by the second driving unit, the third driving unit may first provide constant level precharge signals together to the pixels that are selected through a vertical scan performed by the first driving unit in the horizontal blanking periods before video signals having opposite polarities are supplied to the signal lines. Then, the third driving unit may sequentially provide a black-level precharge signal having the same polarity as that of one of the video signals and a predetermined color level precharge signal having the same polarity as that of the other video signal. Subsequently, the second driving unit may provide the video signals having opposite polarities to the signal lines.

DESCRIPTION OF THE PREFERRED EMBODIMENT

Hereinbelow, preferred embodiments of the present invention are described in detail with reference to the drawings.

Figure 1:
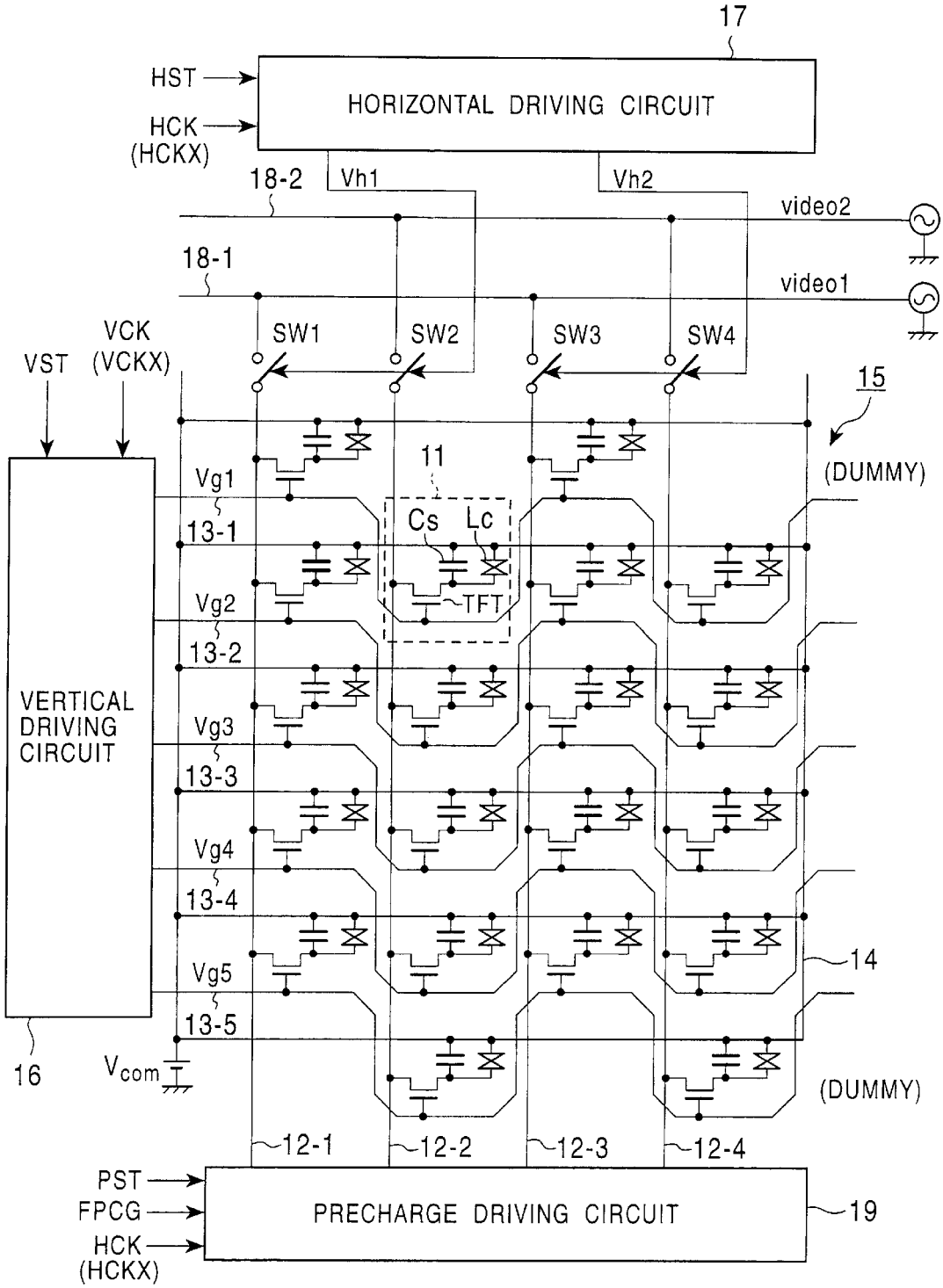
FIG. 1 is a circuit diagram of an active matrix liquid crystal display driven by a dot-line inversion driving method in combination with a 2-step dot sequential precharge driving method according to the present invention.

FIG. 1 is a circuit diagram of an active matrix liquid crystal display driven by a dot-line inversion driving method in combination with a 2-step dot sequential precharge driving method according to the present invention. For clarification of the illustration, by the way of example, the active matrix liquid crystal display shown in FIG. 1 has a pixel array in a 6-row and 4-column matrix, or a 6×4 matrix. It is noted that dummy pixels are arranged every other column in the first and sixth rows so that specific color signals, such as black signals, rather than video signals, are written to the pixels.

In FIG. 1, six rows and four columns of pixels 11 are arranged in a matrix in which odd columns of pixels are only arranged in the first row as dummy and even columns of pixels are only arranged in the sixth row as dummy. Each of the pixels 11 is formed of a thin film transistor TFT which is a pixel transistor, a liquid crystal cell LC having a pixel electrode connected to the drain electrode of the thin film transistor TFT, and a holding capacitor Cs having one electrode connected to the drain electrode of the thin film transistor TFT.

Each of signal lines 12-1 to 12-4 extends along the pixel arrangement in a column of pixels 11. On the other hand, each of gate lines 13-1 to 13-5 extends across two odd-numbered rows that are spaced apart, e.g., two lines (rows) apart vertically, in a meandering fashion therebetween, rather than extending along the pixel arrangement in a row of pixels 11.

Specifically, the gate line 13-1 extends through the first-row and first-column pixel, the second-row and second-column pixel, the first-row and third-column pixel, and the second-row and fourth-column pixel. The gate line 13-2 extends through the second-row and first-column pixel, the third-row and second-column pixel, the second-row and third-column pixel, and the third-row and fourth-column pixel. Likewise, the gate lines 13-3, 13-4, and 13-5 each extend in a meandering fashion between two rows of pixels apart vertically.

The source electrode (or drain electrode) of the thin film transistor TFT in each of the pixels 11 is connected to the corresponding one of the signal lines 12-1 to 12-4. The counter electrode of the liquid crystal cell LC and the other electrode of the holding capacitor Cs in each of the pixels 11 are connected to a Cs line 14. The Cs lines 14 are commonly provided in the pixels 11. A predetermined dc voltage is applied to the Cs lines 14 as a common voltage Vcom.

The connection relationship of the gate lines 13-1 to 13-5 is now described. The gate electrodes of the thin film transistors TFT in odd columns, i.e., the first and third columns, of pixels 11 are connected to the gate lines 13-1 to 13-5 which extend along the corresponding rows (the first to fifth rows). The gate electrodes of the thin film transistors TFT in even columns, i.e., the second and fourth columns, of pixels 11 are connected to the gate lines 13-1 to 13-5 which extend along the rows which are located one-row above with respect to the corresponding rows (the second to sixth rows).

The pixels 11 are thus arranged into a matrix to form a pixel section 15 in which the signal lines 12-1 to 12-4 extend along columns of pixels 11, and the gate lines 13-1 to 13-5 each extend across two odd-numbered rows that are spaced apart, e.g., two lines (rows) apart vertically, in a meandering fashion therebetween. In the pixel section 15, one end of each of the gate lines 13-1 to 13-5 is connected to an output end of a vertical driving circuit 16 which may be placed to the left with respect to the pixel section 15.

The vertical driving circuit 16 performs a vertical scan (in the pixel row direction) every one field to select sequentially the pixels 11 that are alternately connected to the gate lines 13-1 to 13-5 across the two rows apart vertically.

Specifically, when a scan pulse Vg1 is applied from the vertical driving circuit 16 to the gate line 13-1, the first-row and first-column pixel, the second-row and second-column pixel, the first-row and third-column pixel, and the second-row and fourth-column pixel are selected. When a scan pulse Vg2 is applied to the gate line 13-2, the second-row and first-column pixel, the third-row and second-column pixel, the second-row and third-column pixel, and the third-row and fourth-column pixel are selected. When scan pulses Vg3, Vg4, and Vg5 are in turn applied to the gate lines 13-3, 13-4, and 13-5, respectively, the pixels are alternately selected in the horizontal direction (in the pixel column direction) in the same way across the two rows apart vertically. A specific structure of the vertical driving circuit 16 is described later in detail.

A horizontal driving circuit 17 may be disposed above the pixel section 15. The horizontal driving circuit 17 sequentially samples every 1H, for example, two types of video signals video1 and video2, to write the result to the pixels 11 that are selected by the vertical driving circuit 16. The two types of video signals video1 and video2 may be video signals having polarities that are inverted every 1H and which are opposite with respect to a reference voltage (common voltage Vcom). As defined herein, the video signal having a higher potential than the common voltage Vcom is positive (H) and the video signal having a lower potential is negative (L).

Sampling switches SW1 and SW3 are connected between a video line 18-1 through which the video signal video1 is input and, for example, the odd-column signal lines 12-1 and 12-3 of the pixel section 15, respectively. Sampling switches SW2 and SW4 are connected between a video line 18-2 through which the video signal video2 is input and the even-column signal lines 12-2 and 12-4 of the pixel section 15, respectively.

The sampling switches SW1 and SW2 are paired, and the sampling switches SW3 and SW4 are paired. In response to sampling pulses Vh1 and Vh2 that are output in turn from the horizontal driving circuit 17, the pairs of sampling switches SW1 and SW2, and SW3 and SW4 are sequentially turned on, so that the two types of video signals video1 and video2 having polarities opposite to each other may be written via the signal lines 12-1 to 12-4 on a two-column (two-pixel) basis.

A precharge driving circuit 19 may be disposed below the pixel section 15. The precharge driving circuit 19 serves to write a black-level precharge signal and a predetermined color level precharge signal, such as a gray-level precharge signal, in a 2-step dot sequential manner in advance before the video signals video1 and video2 are written, in order to reduce a charging/discharging current due to the writing of the video signals video1 and video2 as much as possible. A specific structure and operation of the precharge driving circuit 19 are described later in detail.

Now, the fundamental operation of the active matrix liquid crystal display driven by the dot-line inversion driving method in combination with the 2-step dot sequential precharge driving method according to the present invention is described with reference to a timing chart shown in FIG. 2. The addressing of the pixels 11 in the 6 (4 pixel array is shown in FIG. 3, in which symbol "d" represents a dummy pixel.

In the first line, when the scan pulse Vg1 is output from the vertical driving circuit 16, the scan pulse Vg1 is applied to the gate electrodes of the thin film transistors TFT in the pixels d-1, 1-2, d-3, and 1-4 via the gate line 13-1 to turn on the pixels d-1, 1-2, d-3, and 1-4.

At this time, the video signals video1 and video2 having polarities opposite to each other are input via the video lines 18-1 and 18-2, and the sampling pulses Vh1 and Vh2 are output in turn from the horizontal driving circuit 17. Hence, the pairs of sampling switches SW1 and SW2 and SW3 and SW4 are sequentially turned on.

The video signals video1 and video2 having polarities opposite to each other are first applied to the signal lines 12-1 and 12-2 through the sampling switches SW1 and SW2, respectively. Therefore, the video signal video1 having the negative polarity, as is indicated by L in FIG. 3, is written to the pixel d-1, and the video signal video2 having the positive polarity, as is indicated by H in FIG. 3, is written to the pixel 1-2. It is noted that the video signal video1 to be input is implemented as a black signal, and the black signal is written to the dummy pixel d-1.

Then, the video signals video1 and video2 are applied to the signal lines 12-3 and 12-4 through the sampling switches SW3 and SW4, respectively. Therefore, the video signal video1 having the negative polarity is written to the pixel d-3, and the video signal video2 having the positive polarity is written to the pixel 1-4. It is also noted that the video signal video1 to be input is implemented as a black signal, and the black signal is written to the dummy pixel d-3.

In the second line, when the scan pulse Vg2 is output from the vertical driving circuit 16, the scan pulse Vg2 is applied to the gate electrodes of the thin film transistors TFT in the pixels 1-1, 2-2, 1-3, and 2-4 via the gate line 13-2 to turn on the pixels 1-1, 2-2, 1-3, and 2-4. In the second line, the polarities of the video signals video1 and video2 are inverted with respect to the reference potential.

That is, the video signal video1 becomes positive and the video signal video2 becomes negative in the second line, although the video signal video1 is negative and the video signal video2 is positive in the first line. As the sampling pulses Vh1 and Vh2 are again output in turn from the horizontal driving circuit 17, the pairs of sampling switches SW1 and SW2 and SW3 and SW4 are sequentially turned on.

The video signals video1 and video2 having polarities opposite to each other are first applied to the signal lines 12-1 and 12-2 through the sampling switches SW1 and SW2, respectively. Therefore, the video signal video1 having the positive polarity is written to the pixel 1-1, and the video signal video2 having the negative polarity is written to the pixel 2-2. Subsequently, the video signals video1 and video2 are applied to the signal lines 12-3 and 12-4 through the sampling switches SW3 and SW4, respectively. Therefore, the video signal video1 having the positive polarity is written to the pixel 1-3, and the video signal video2 having the negative polarity is written to the pixel 2-4.

In the subsequent procedure, the polarities of the video signals video1 and video2 having polarities opposite to each other are inverted every 1H with respect to the reference potential and input, and the above-described operation is repeatedly performed until the scan in the pixel row direction (vertical scan) performed by the vertical driving circuit 16 and the scan in the pixel column direction (horizontal scan) performed by the horizontal driving circuit 17 are completed. It is noted that when the gate line 13-5 is scanned, the video signals video2 to be input are implemented as black signals, and the black signals are written to the dummy pixels d-2 and d-4.

Figures 2, 3:
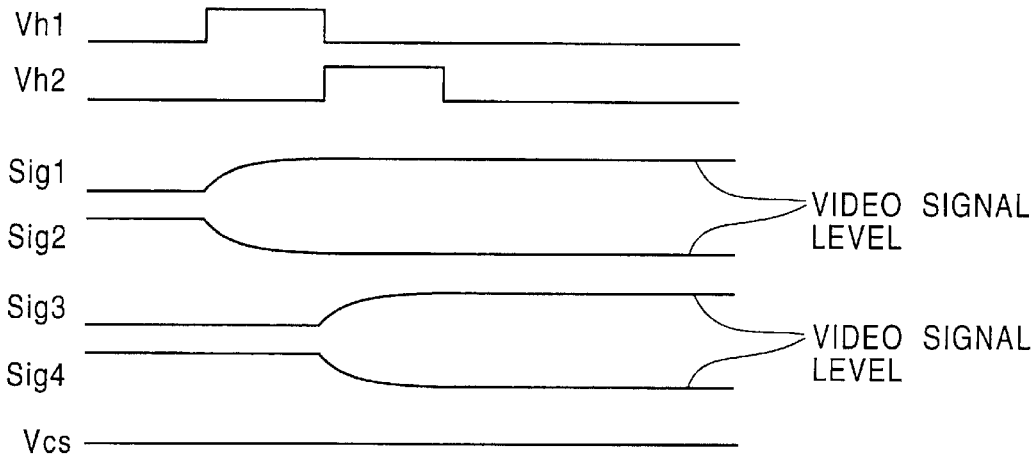
FIG. 2 is a timing chart of the fundamental operation during the dot-line inversion driving.
FIG. 3 is view showing a relation between the addressing of pixels and the polarities of video signals written to the pixels during the dot-line inversion driving.

Accordingly, in the dot-line inversion driving method, for example, when two types of video signals video1 and video2 having polarities opposite to each other with respect to a reference potential are input, the video signals video1 and video2 having opposite polarities are concurrently written to two odd-numbered rows (two rows apart vertically in this example) of pixels that are spaced apart in adjacent pixel columns so that the polarities of vertically adjacent pixels are the same while the polarities of the vertically adjacent pixels are opposite in the array of pixels to which the video signals have been written, as shown in FIG. 3. The dot-line inversion driving method would achieve the following advantages.

As is apparent from the timing chart shown in FIG. 2, when the sampling pulses Vh1 and Vh2 are successively output to sequentially turn on the pairs of sampling switches SW1 and SW2 and SW3 and SW4, the video signals video1 and video2 having polarities opposite to each other with respect to a reference potential are applied to the signal lines 12-1 and 12-3 and the signal lines 12-2 and 12-4, respectively. Therefore, degradation in the picture quality, including horizontal crosstalk, defective shading, and vertical crosstalk, can be prevented.

Specifically, the video signals video1 and video2 having polarities opposite to each other are applied to adjacent signal lines 12-1 to 12-4, thereby making it possible to prevent the deficiency which results from the presence of resistance across the pixels 11 on the Cs lines 14 such that the video signals video1 and video2 jump over onto the Cs lines 14 through the parasitic capacitance at the intersections of the signal lines 12-1 to 12-4 and the Cs lines 14 or through the holding capacitor Cs of the pixels 11. There occurs no oscillation in the potential of the Cs lines 14. Therefore, the horizontal crosstalk or defective shading problem can be overcome.

Furthermore, the video signals video1 and video2 having polarities opposite to each other are applied to adjacent signal lines 12-1 to 12-4, thereby making it possible to prevent the deficiency which results from the presence of parasitic capacitance between the source-drain electrodes of the thin film transistors TFT and the signal lines 12-1 to 12-4 such that the potentials of the signal lines 12-1 to 12-4 which oscillate every 1H jump over to the pixels 11 due to the source-drain coupling of the thin film transistors TFT. This prevents vertical crosstalk. Therefore, the video signals video1 and video2 can be written at the sufficient level, thereby improving the contrast.

Furthermore, in the illustrated embodiment, the video signals video1 and video2 having polarities opposite to each other are written to the pixels every other column (every other pixel) across two different lines (two lines apart vertically in this example), rather than the pixels on one line in the horizontal direction as in the dot inversion driving method. Hence, the polarities of horizontally adjacent pixels in the array of pixels to which the video signals have been written are the same, as shown in FIG. 3, thereby preventing the domain problem exhibited by the dot inversion driving method. Therefore, no need exists to reduce the aperture rate of the pixels, and the contrast is no longer reduced.

While the two types of video signals video1 and video2 are input in the illustrated embodiment, the number of video signal inputs is not limited to two, but may be $2m$, where m is an integer. Although the video signals video1 and video2 having opposite polarities are concurrently written to two rows of pixels apart vertically in the illustrated embodiment, they are not necessarily written to two rows of pixels apart vertically. What is merely required is that the video signals are concurrently written to pixels on different horizontal lines so that the polarities of the horizontally adjacent pixels may be the same and the polarities of the vertically adjacent pixels may be opposite in the array of pixels to which the video signals have been written.

While an implementation of a liquid crystal display incorporating an analog interface driving circuit which receives and samples an analog video signal to drive pixels in a dot-sequential manner has been described in the illustrated embodiment, the present invention is not limited on this type of device. The present invention may also be applied to a liquid crystal display incorporating a digital interface driving circuit which receives and latches a digital video signal, converts the latched digital video signal into an analog video signal, and samples the resulting signal to drive pixels in a dot-sequential manner.

In the active matrix liquid crystal display driven by the dot-line inversion driving method in combination with the 2-step dot sequential precharge driving method, as described above, the present invention is directed to a specific structure of the precharge driving circuit 19 and a driving method thereof.

Figure 4:
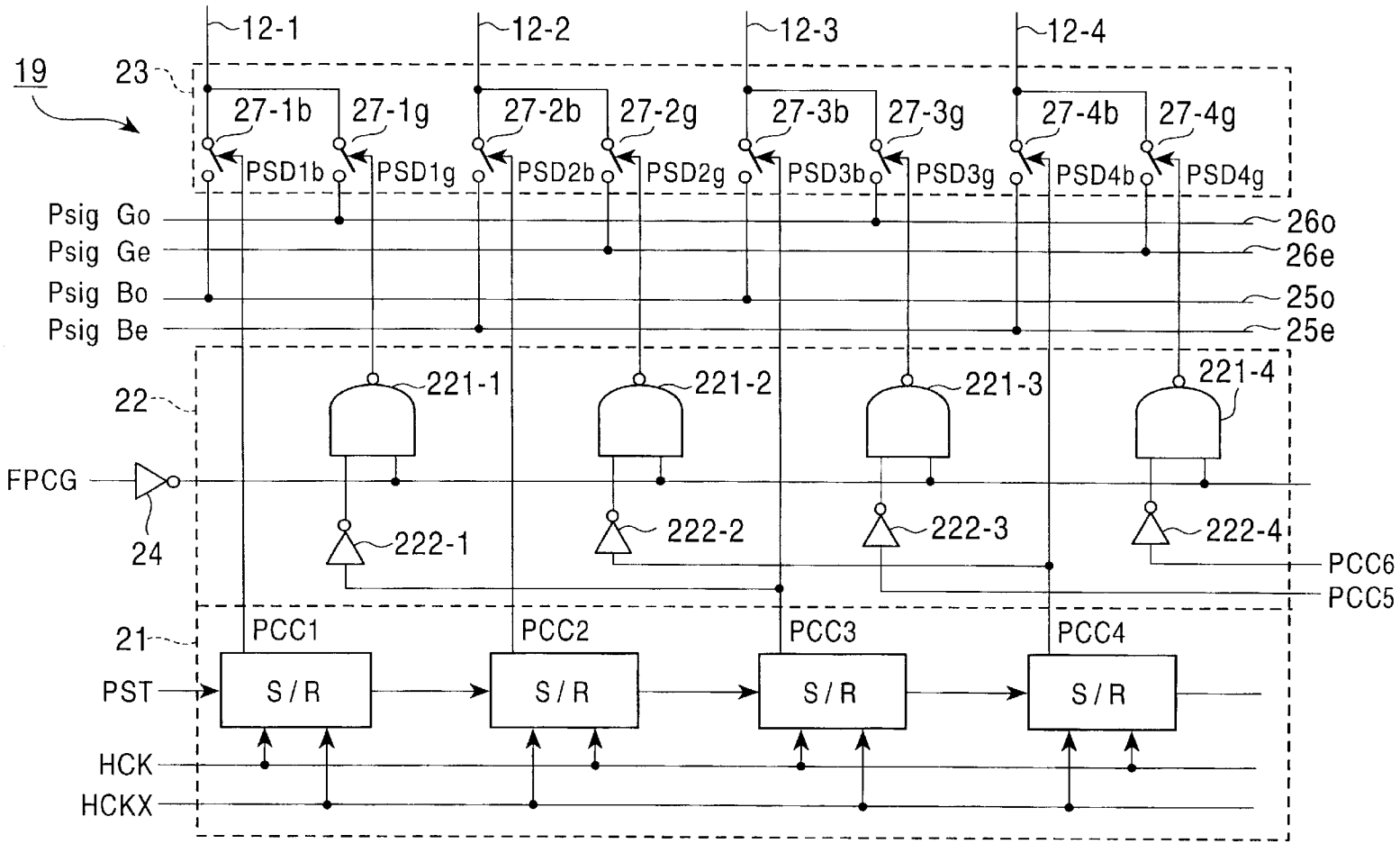
FIG. 4 is a block diagram showing a specific structure of a precharge driving circuit according to the present invention.

FIG. 4 is a block diagram showing a specific structure of the precharge driving circuit 19. In FIG. 4, the precharge driving circuit 19 includes a shift register 21, a logic gate circuit 22, and a precharge switching circuit 23.

The shift register 21 receives a precharge start pulse PST which commands the start of the precharge and horizontal clocks HCK and HCKX having phases opposite to each other according to which the horizontal scan is performed by the horizontal driving circuit 17. When the precharge start pulse PST is input, the shift register 21 shifts the precharge start pulse PST in turn to shift stages (S/Rs) in synchronization with the horizontal clocks HCK and HCKX, and successively outputs it as precharge control pulses PCC1, PCC2, and so on from the shift stages.

The precharge control pulses PCC1, PCC2, etc. are supplied to the logic gate circuit 22. The logic gate circuit 22 also receives a full-line precharge pulse FPCG that has been inverted by an inverter 24, as is described later. The logic gate circuit 22 includes NAND gates 221-1, 221-2, and so on which correspond to the signal lines 12-1, 12-2, and so on of the pixel section 15 and inverters 222-1, 222-2, 222-3, and so on.

In the logic gate circuit 22, the full-line precharge pulse FPCG that has been inverted by the inverter 24 is applied to first inputs, and the precharge control pulses PCC3, PCC4, etc. successively output from the third and subsequent shift stages (S/Rs) are applied to second inputs of the NAND gates 221-1, 221-2, etc.

Typically, the full-line precharge pulse PFCG is in the L level, so that the first inputs of the NAND gates 221-1, 221-2, etc. are in the H level, and the second inputs of the NAND gates 221-1, 221-2, etc. are in the H level. When the precharge control pulses PCC3, PCC4, etc. are successively output from the third and subsequent shift stages of the shift register 21 to apply L-level pulses to the second inputs of the NAND gates 221-1, 221-2, etc., H-level pulses are sequentially output from the NAND gates 221-1, 221-2, etc.

The precharge switching circuit 23 receives an odd-column precharge black signal PsigBo via a precharge signal line 25*o*, an even-column precharge black signal PsigBe via a precharge signal line 25*e*, an odd-column precharge gray signal PsigGo via a precharge signal line 26*o*, and an even-column precharge gray signal PsigGe via a precharge signal line 26*e*.

In the precharge switching circuit 23, a precharge switch 27-1*b* is connected between the signal line 12-1 of the pixel section 15 and the precharge signal line 25*o*, a precharge switch 27-1*g* is connected between the signal line 12-1 and the precharge signal line 26*o*, a precharge switch 27-2*b* is connected between the signal line 12-2 and the precharge signal line 25*e*, and a precharge switch 27-2*g* is connected between the signal line 12-2 and the precharge signal line 26*e*. Other precharge switches are further connected in the same way.

The precharge control pulses PCC1, PCC2, PCC3, etc. that are output from the shift stages of the shift register 21 and the output pulses of the NAND gates 221-1, 221-2, 221-3, etc. in the logic gate circuit 22 are used as drive signals of the precharge switches 27-1*b*, 27-1*g*, 27-2*b*, 27-2*g*, etc.

Specifically, the precharge control pulse PCC1 from the first stage is applied to the precharge switch 27-1*b* as a switch driving pulse PSD1*b*, the output pulse of the NAND gate 221-1 is applied to the precharge switch 27-1*g* as a switch driving pulse PSD1*g*, the precharge control pulse PCC2 from the second stage is applied to the precharge switch 27-2*b* as a switch driving pulse PSD2*b*, and the output pulse of the NAND gate 221-2 is applied to the precharge switch 27-2*g* as a switch driving pulse PSD2*g*. Other precharge control pulses or output pulses are further applied in the same way to the subsequent precharge switches.

Figure 5:
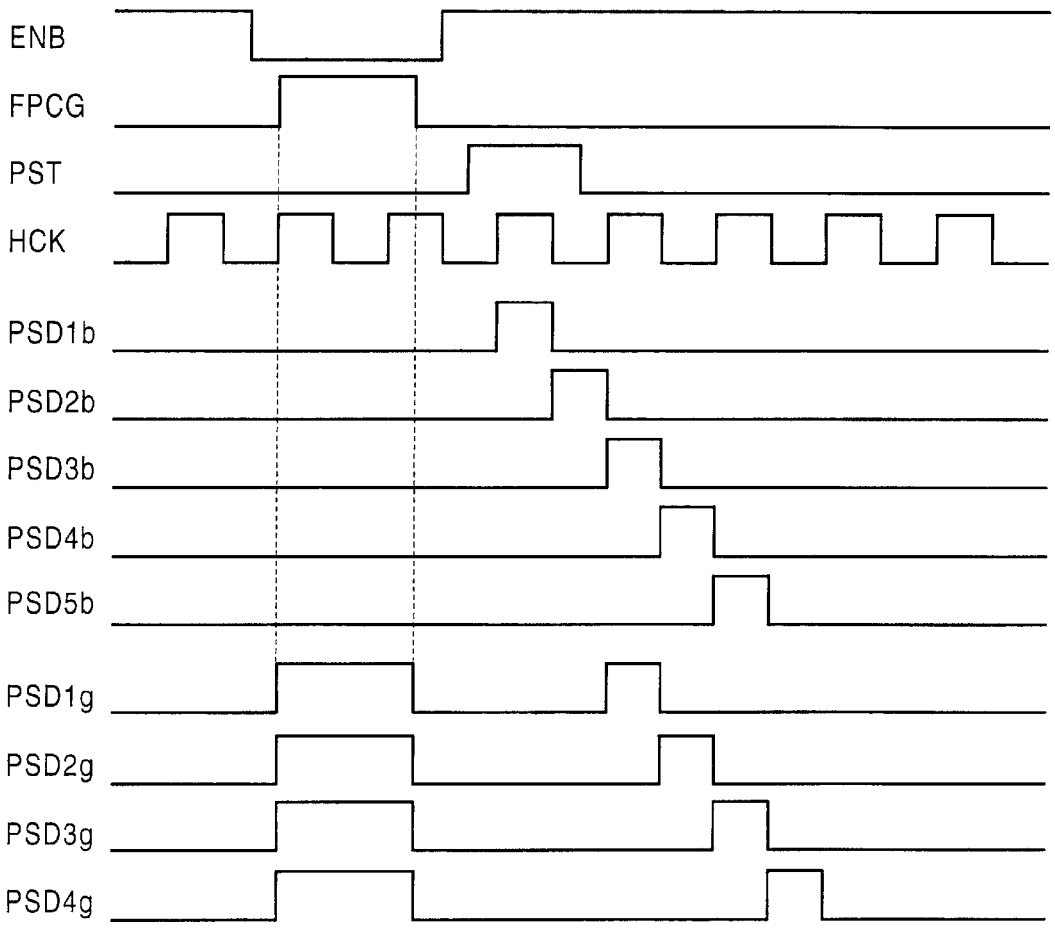
FIG. 5 is a timing chart which illustrates the circuit operation of the precharge driving circuit according to the present invention.

FIG. 5 is a timing chart of the enable pulse ENB, the full-line precharge pulse FPCG, the precharge start pulse PST, the horizontal clock HCK, the black-level switch driving pulses PSD1*b*, PSD2*b*, PSD3*b*, PSD4*b*, and PSD5*b*, and the gray-level switch driving pulses PSD1*g*, PSD2*g*, PSD3*g*, and PSD4*g*.

The enable pulse ENB is generated in a period of 1H. While the vertical scan is performed by the vertical driving circuit 16, the write operation of the video signals video1 and video2 to one row of pixels is allowed on a row-by-row basis when the enable pulse ENB is in the H level. In the L-level duration, during which the write operation on a row proceeds to the write operation on another row, the pixel transistors (thin film transistors TFT) are turned off, and the write operation of the video signals video1 and video2 to the pixels 11 is prohibited.

Figure 6:
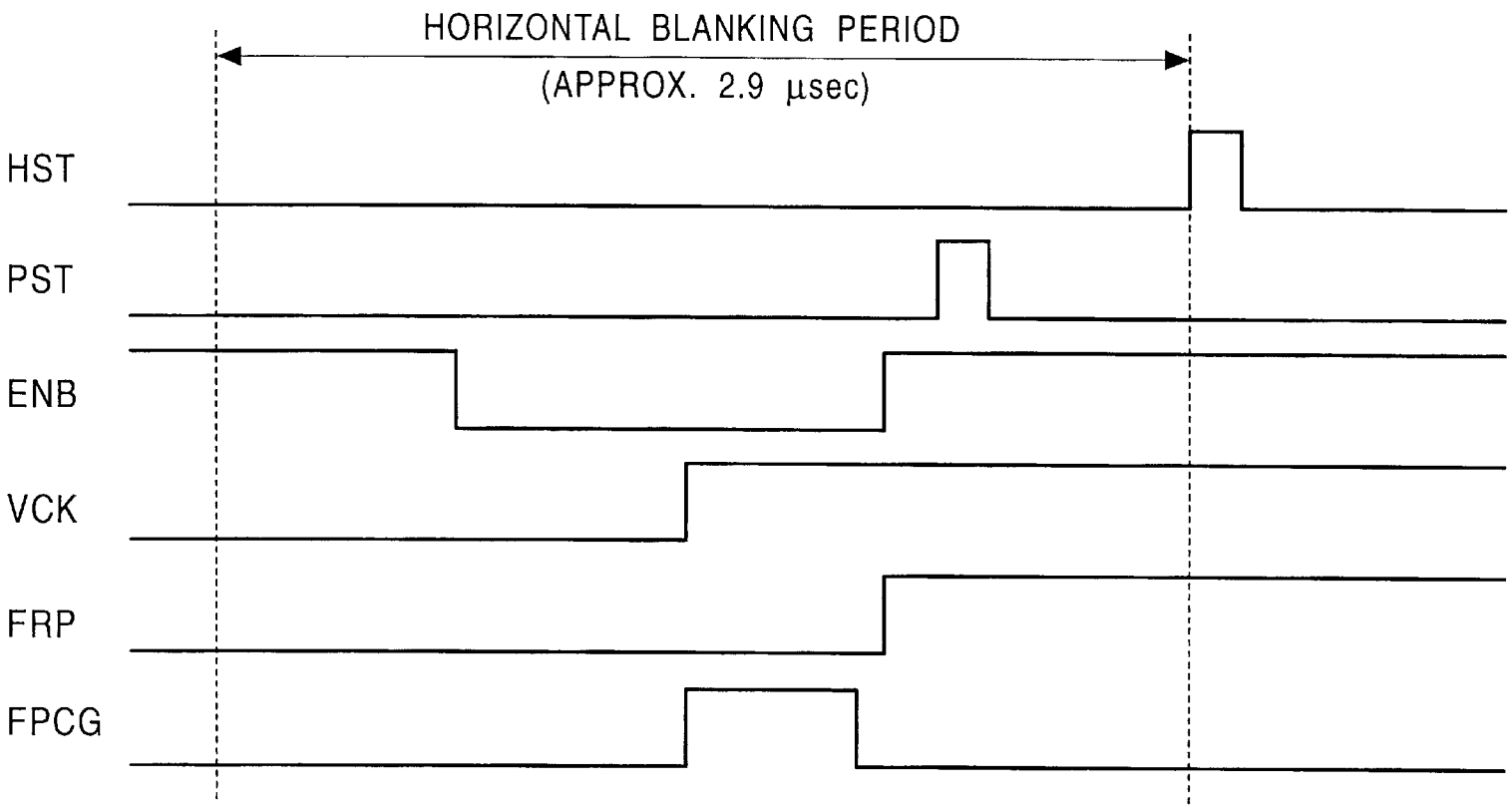
FIG. 6 is a timing chart of the timing at which a full-line precharge is performed.

As can be seen from the timing chart shown in FIG. 6, the L-level duration of the enable pulse ENB continues in a part of a horizontal blanking period of approximately 2.9 ?sec. In the timing chart shown in FIG. 6, HST represents a horizontal start pulse which commands the start of the horizontal scan, VCK represents a vertical clock according to which the vertical scan is performed, and FRP represents a timing pulse which causes the polarities of the video signals video1 and video2 to be inverted.

In the timing relation shown in FIG. 6, the full-line precharge pulse FPCG is turned H level in the horizontal blanking period, preferably in a portion of the L-level duration of the enable pulse ENB, for example, in synchronization with the vertical clock VCK. The various timing signals, including the full-line precharge pulse FPCG, are generated by a timing generating circuit (not shown).

While the horizontal scan is performed by the horizontal driving circuit 17, the precharge driving circuit 19 according to the present invention performs a full-line precharge, as is described later, before the video signals video1 and video2 having polarities opposite to each other are written to the signal lines 12-1, 12-2, etc. The precharge driving circuit 19 also performs a 2-step precharge in which the precharge black signal PsigBo and the precharge gray signal PsigGo that are input with the same polarity as that of the video signal video1 and the precharge black signal PsigBe and the precharge gray signal PsigGe that are input with the same polarity as that of the video signal video2 are written to the signal lines 12-1, 12-2, etc.

The precharge operation of the precharge driving circuit 19 is described with reference to the timing chart shown in FIG. 5.

First, the full-line precharge operation is described. As the full-line precharge pulse FPCG is input in the horizontal blanking period, e.g., in the L-level duration of the enable signal ENB, the full-line precharge pulse FPCG passes through the NAND gates 221-1, 221-2, etc. in the logic gate circuit 22 and is concurrently applied to the precharge switches 27-11g, 27-2*g*, etc. as the gray-level switch driving pulses PSD1*g*, PSD2*g*, etc. This allows the precharge switch 27-1*g*, 27-2*g*, etc. to be turned on at one time, thereby writing the precharge gray signals having the same polarity as that of the previous-stage pixel potential to all of the signal lines 12-1, 12-2, etc.

In order to prevent the precharge gray signals PsigGo and PsigGe from being written to the pixels 11, as shown in the timing chart in FIG. 6, the full-line precharge pulse FPCG should initiated after the timing of the trailing edge of the enable signal ENB and terminated before the timing of the leading edge of the timing pulse FRP in order to write the precharge gray signals having the same polarity as that of the previous-stage pixel potential.

Figure 7:
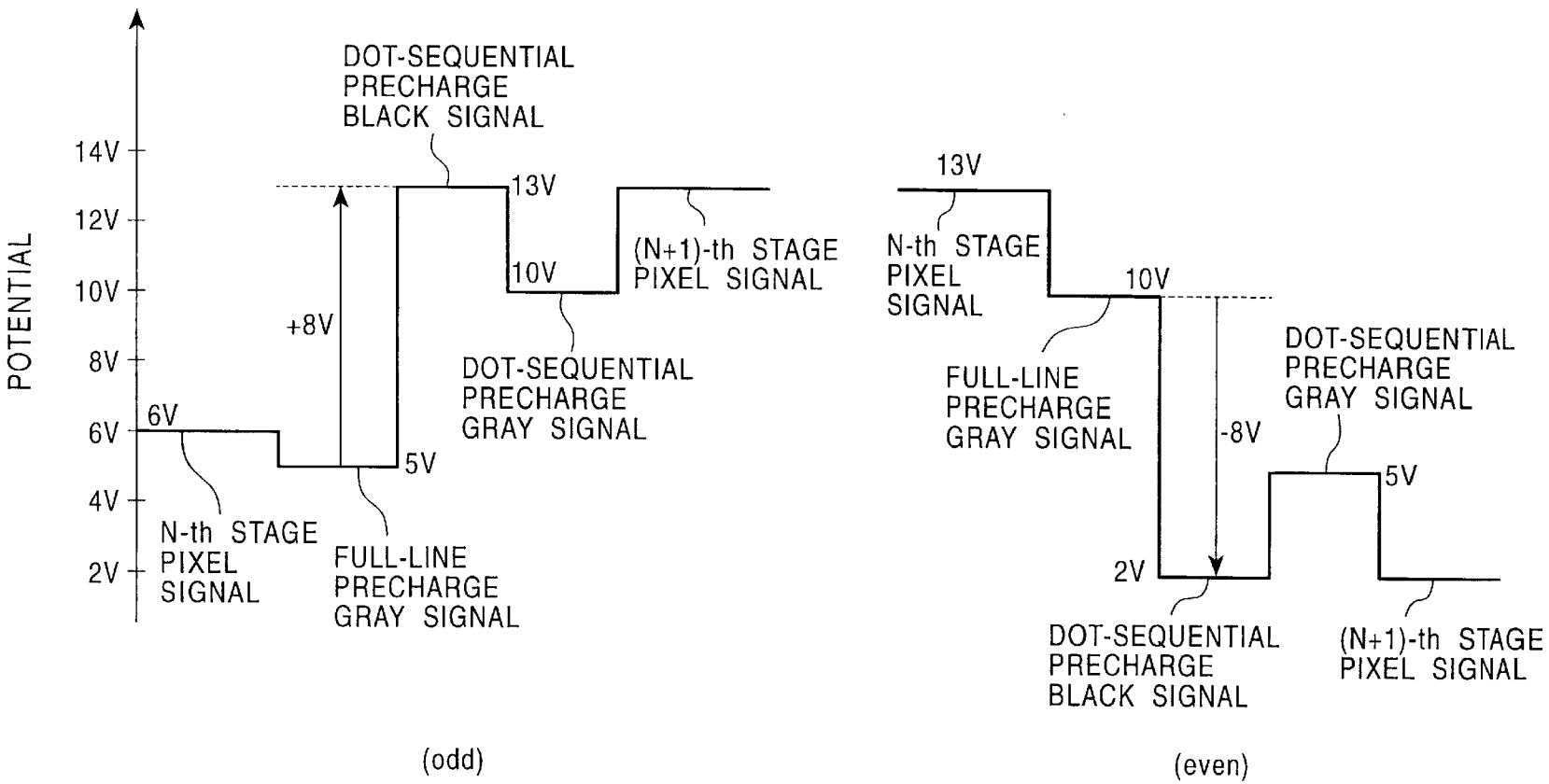
FIG. 7 is a potential diagram of the potential variations of signal lines in the precharge operation which involves the full-line precharge.
Figure 8:
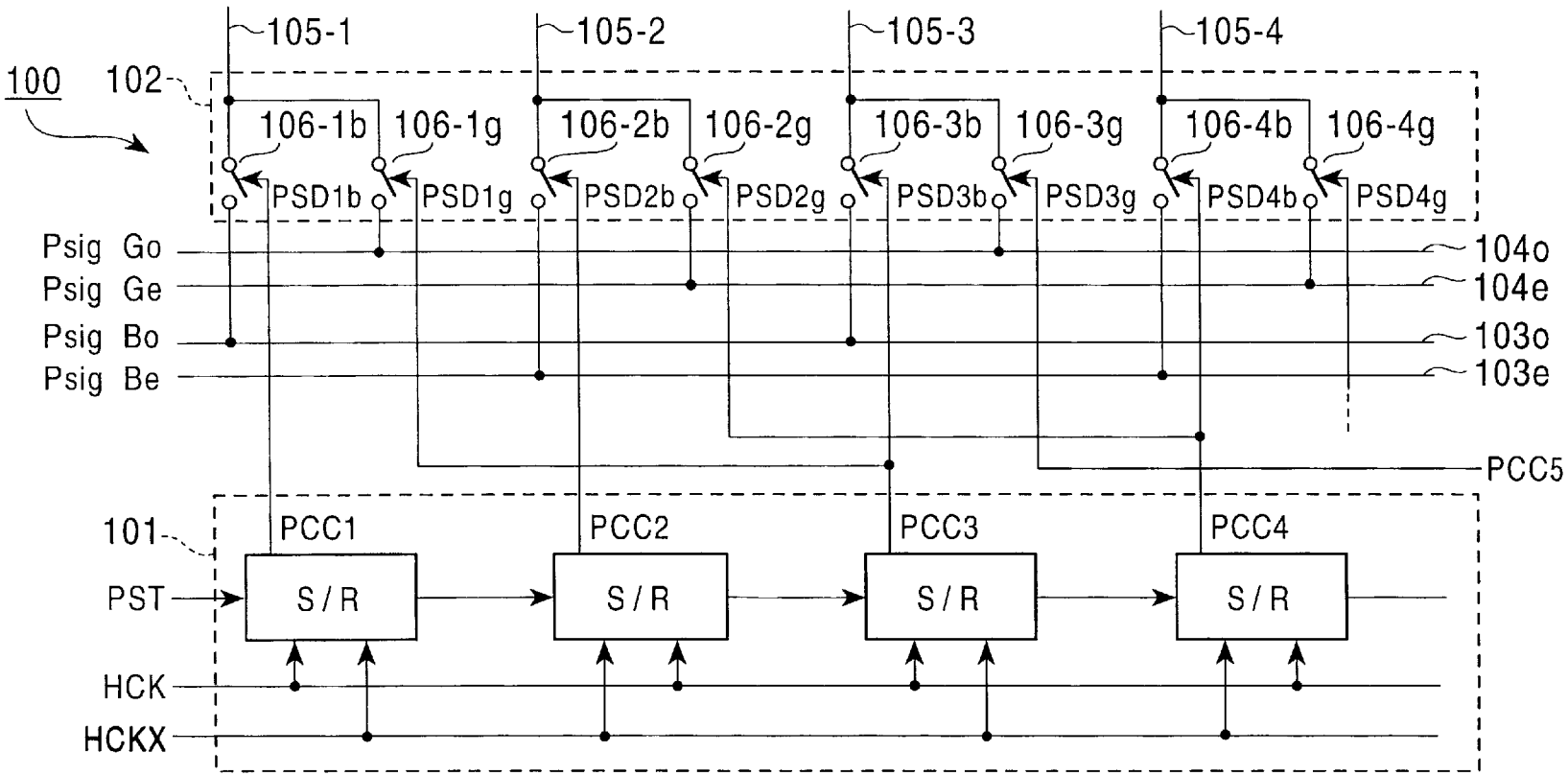
FIG. 8 is a block diagram of a precharge driving circuit as a conventional example.
Figure 9:
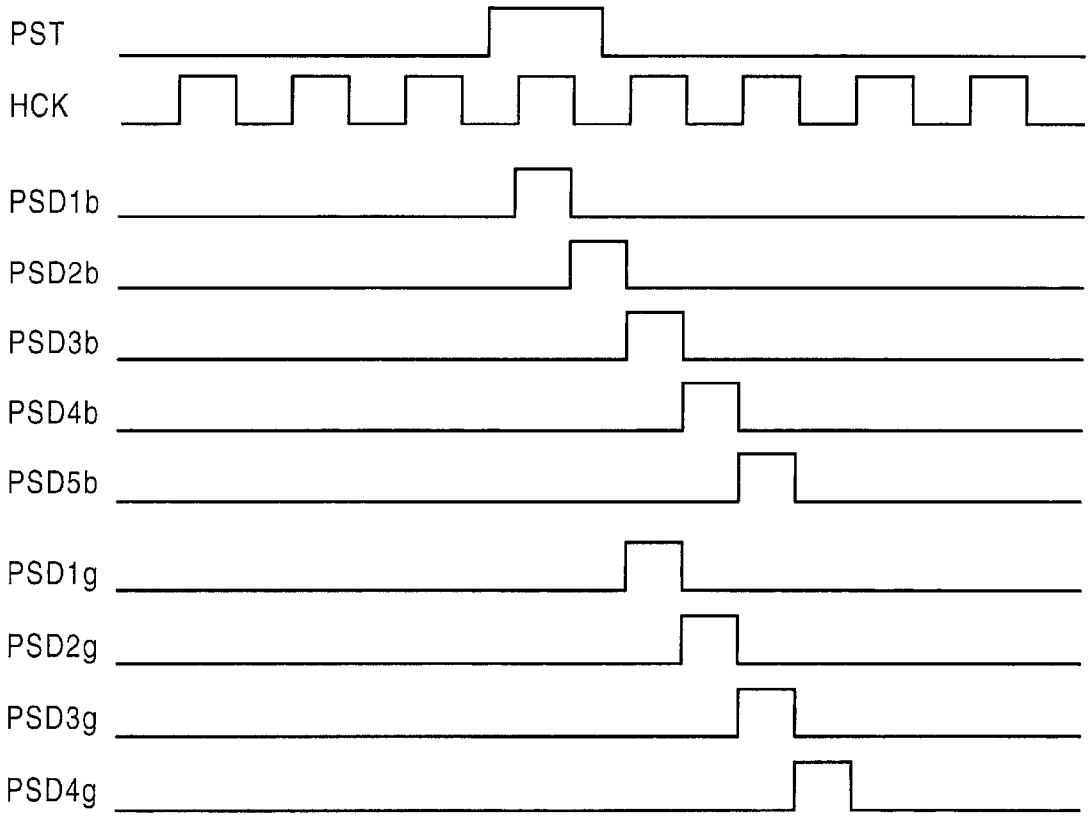
FIG. 9 is a timing chart of the circuit operation of the precharge driving circuit.
Figure 10:
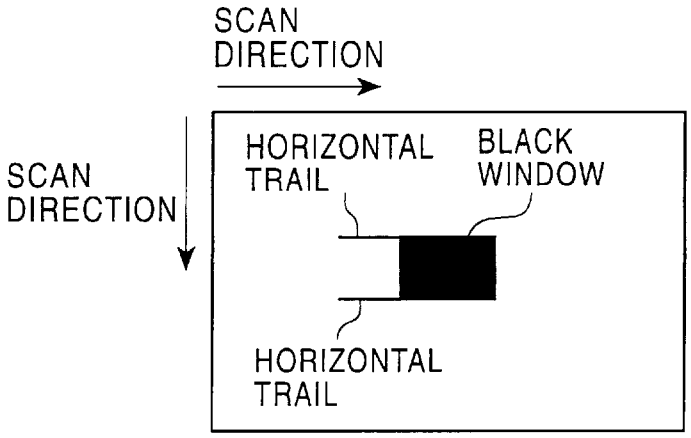
FIG. 10 is an illustration of the display state when a black window is displayed.
Figure 11:
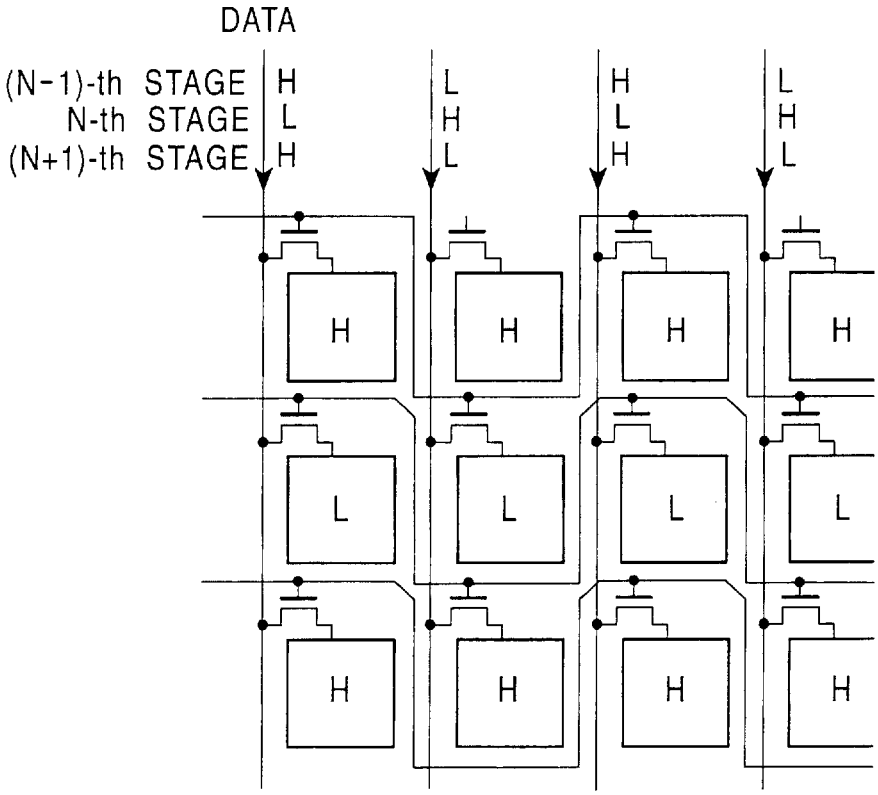
FIG. 11 is view showing the polarities of pixel potentials during the dot-line inversion driving.
Figure 12:
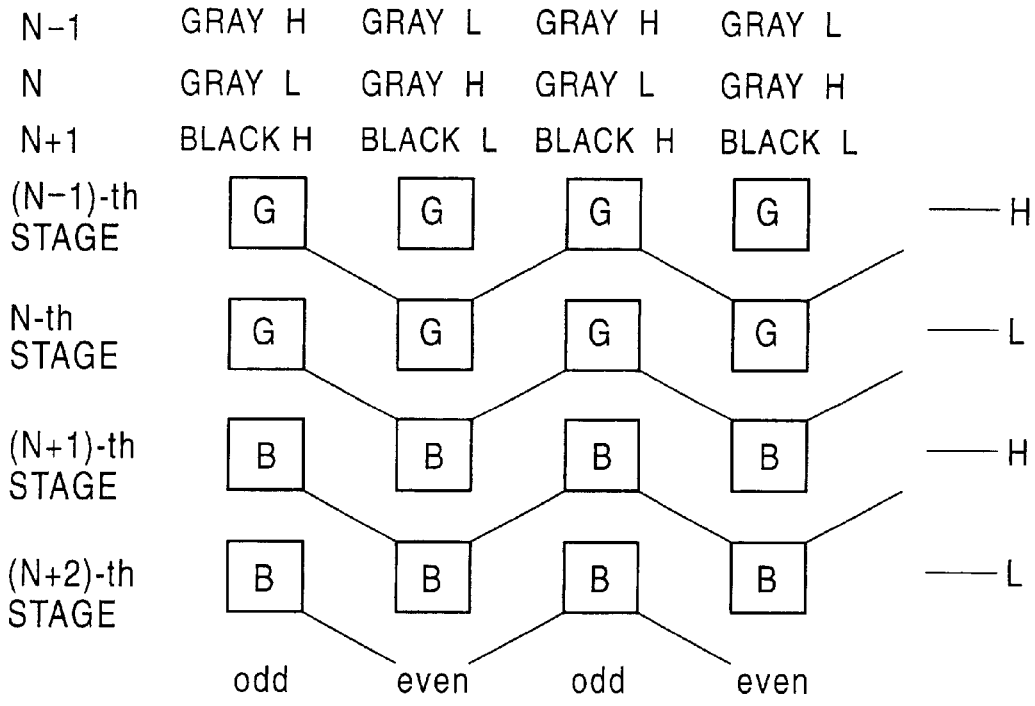
FIG. 12 is a view showing, when black windows or black lines are displayed, the pixel potentials of circumscribing portions thereof.
Figure 13:
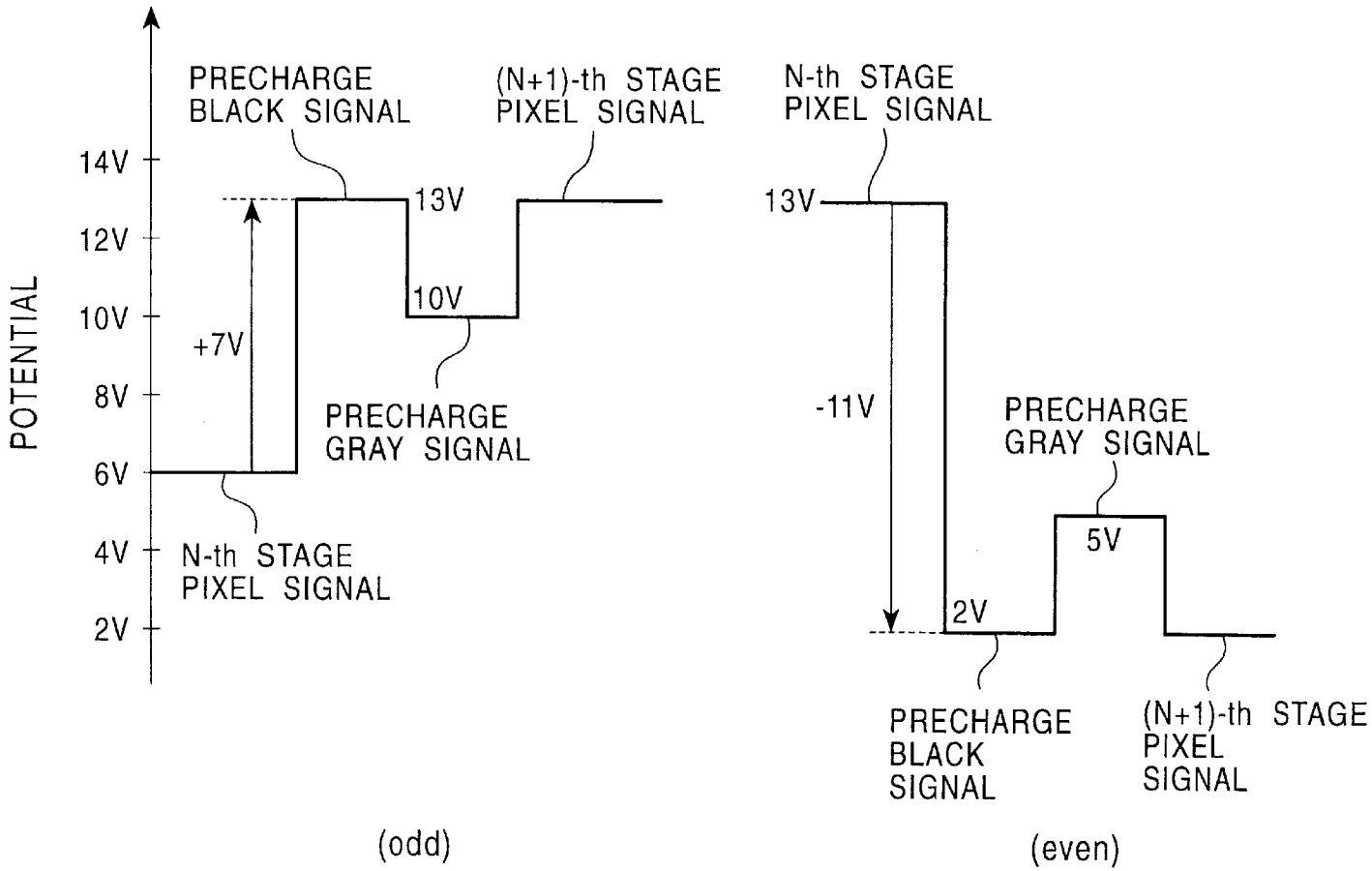
FIG. 13 is a potential diagram of the potential variations of signal lines during the 2-step dot sequential precharge driving.

FIG. 7 shows how the potentials of signal lines vary during the precharge operation which involves the full-line precharge.

In this illustration, as an example, the H and L levels of the dot-sequential precharge gray signal are set at 10 V and 5 V, respectively, the H and L levels of the dot-sequential precharge black signal are set at 13 V and 2 V, respectively, and the H and L levels of the full-line precharge gray signal are set at 10 V and 5 V, respectively. In a pixel signal, typically, the H and L levels of the gray signal are 9 V and 6 V, respectively, and the H and L levels of the black signal are 13 V and 2 V, respectively.

As is apparent from the potential variations of the signal lines shown in FIG. 7, in the horizontal blanking periods during which no video signal is written to the pixels 11, the full-line precharge is performed to individually write a precharge gray signal having constant levels (the H level is 10 V and the L level is 5 V in this example) to the signal lines 12-1, 12-2, etc., thereby making the potential amplitude of the signal lines 12-1, 12-2, etc. equal between odd columns and even columns with respect to the common potential Vcom.

Accordingly, the potential variations of the signal lines 12-1, 12-2, etc. are +8 V for an odd column and −8 V for an even column when the dot-sequential precharge black signals are written later, of which the absolute values are equal. Therefore, the coupling from the signal lines 12-1, 12-2, etc. to the Cs lines 14 or the gate lines 13-1, 13-2, etc. can be completely cancelled out. As a result, no oscillation is applied to the Cs lines 14 or the gate lines 13-1, 13-2, etc., and no horizontal trail resulting from such an oscillation occurs.

Meanwhile, the potential variations from the N-th stage pixel potential to the full-line precharge signal level are −1 V for an odd column and −3 V for an even column, of which the absolute values are different. Therefore, the coupling from the signal lines 12-1, 12-2, etc. to the Cs lines 14 or the gate lines 13-1, 13-2, etc. cannot be cancelled out, and oscillations are carried on the Cs lines 14 and the gate lines 13-1, 13-2, etc. However, the full-line precharge is performed in the horizontal blanking periods during which the pixel transistors (thin film transistors TFT) are turned off, and such oscillations are not applied in the horizontal blanking periods. Consequently, there occurs no horizontal trail resulting from the oscillations applied to the Cs lines 14 or the gate lines 13-1, 13-2, etc.

In the illustrated embodiment, the precharge signal for the full-line precharge is implemented as a precharge gray signal (5 V) having the same polarity as that of the previous-stage pixel potential. However, the signal level is arbitrary, and the signal may not necessarily have the same polarity as that of the previous-stage pixel potential. Since the full-line precharge is performed in an extremely short period of the horizontal blanking periods, preferably, the signal has the same polarity as that of the previous-stage pixel potential in order to ensure the write of the dot-sequential precharge black signal immediately after the full-line precharge.

Next, the 2-step dot sequential precharge operation is described. When the precharge start pulse PST is applied to the shift register 21, the precharge control pulses PCC1, PCC2, PCC3, etc. are sequentially output from the shift stages of the shift register 21 in synchronization with the horizontal clocks HCK and HCKX.

The precharge control pulses PCC1, PCC2, etc. are sequentially applied to the precharge switches 27-1*b*, 27-2*b*, etc. as the black-level switch driving pulses PSD1*b*, PSD2*b*, etc. The output pulses of the NAND gates 221-1, 221-2, etc. are sequentially applied to the precharge switches 27-1*g*, 27-2*g*, etc. as the gray-level switch driving pulses PSD1*g*, PSD2*g*, etc.

With the series of operations, before the video signals video1 and video2 having polarities opposite to each other are written to the pixels, the precharge black signal PsigBo and the precharge gray signal PsigGo that are input with the same polarity as that of the video signal video1, and the precharge black signal PsigBe and the precharge gray signal PsigGe that are input with the same polarity as that of the video signal video2 can be written in two steps to each row of pixels which is selected through the vertical scan performed by the vertical driving circuit 16.

Although an implementation of a liquid crystal display using liquid crystal cells as display elements of pixels has been described by way of example in the illustrated embodiment, the present invention is not limited to the implementation of the liquid crystal display. The present invention may be generally applied to display devices driven by the dot-line inversion driving method in combination with the dot sequential precharge dive method.

According to the present invention, therefore, in a display device driven by the dot-line inversion driving method in combination with the dot sequential precharge driving method, during the horizontal scan, and before video signals having polarities opposite to each other are supplied to signal lines, constant level precharge signals are all together written in the horizontal blanking periods, followed by a 2-step precharge. This can cancel out the coupling from the signal lines to Cs lines or gate lines in the write operation of precharge black signals. Therefore, if black windows or black lines are displayed, there occurs no horizontal trail on circumscribing portions thereof.

What is claimed is:

1. A display device comprising:

a pixel section having pixels arranged in a matrix, a signal line extending along each column of pixels, and a gate line extending across two odd-numbered rows which are spaced apart in adjacent pixel columns;

first driving means for applying scan pulses to the gate lines while scanning the pixels of said pixel section in the row direction;

second driving means for sequentially providing video signals having opposite polarities to adjacent pixels via the signal lines, the pixels being connected to the gate lines to which the scan pulses are applied by said first driving means; and third driving means for providing constant level precharge signals together in the horizontal blanking periods before the video signals having opposite polarities are applied to the signal lines by said second driving means, and then sequentially providing a black-level precharge signal and a predetermined color level precharge signal, the black-level precharge signal having the same polarity as that of one of the video signals and the predetermined color level precharge signal having the same polarity as that of the other video signal.

2. The display device according to claim 1, wherein said third driving means provides the constant level precharge signals together when pixel transistors in said pixel section are turned off.

3. The display device according to claim 1, wherein the constant level precharge signals have the same polarity as that of the previous signal line potential, and each of the constant level precharge signals is the predetermined color level precharge signal.

4. The display device according to claim 3, wherein the predetermined color level is a gray level.

5. The display device according to claim 1, wherein the pixels include display elements and the display elements comprise liquid crystal cells.

6. A method of driving a display device, for writing video signals having polarities opposite to each other to two odd-numbered rows of pixels that are spaced apart in adjacent pixel columns so that the polarities of the horizontally adjacent pixels are the same while the polarities of the vertically adjacent pixels are opposite in the array of pixels to which the video signals have been written, said method comprising the steps of:

providing constant level precharge signals together in the horizontal blanking periods during the horizontal scan before the video signals having opposite polarities are applied to signal lines; and then sequentially providing a black-level precharge signal and a predetermined color level precharge signal, the black-level precharge signal having the same polarity as that of one of the video signals and the predetermined color level precharge signal having the same polarity as that of the other video signal.

7. The method according to claim 6, wherein pixel transistors are turned off when the constant level precharge signals are provided together.

8. The method according claim 6, wherein the constant level precharge signals have the same polarity as that of the previous signal line potential, and each of the constant level precharge signals is the predetermined color level precharge signal.

9. The method according to claim 8, wherein the predetermined color level is a gray level.

10. The method according to claim 6, wherein the pixels include display elements, and the display elements comprise liquid crystal cells.

* * * * *